United States Patent [19]

Stempin et al.

[11] 4,298,382

[45] Nov. 3, 1981

[54] METHOD FOR PRODUCING LARGE METALLIC GLASS BODIES

[75] Inventors: John L. Stempin, Beaver Dams; Dale R. Wexell, Corning, both of N.Y.

[73] Assignee: Corning Glass Works, Corning, N.Y.

[21] Appl. No.: 55,176

[22] Filed: Jul. 6, 1979

[51] Int. Cl.[3] ..... B22F 1/00; B22F 3/14

[52] U.S. Cl. ..... 75/202; 75/200; 75/226

[58] Field of Search ..... 75/200, 226, 202

[56] References Cited

U.S. PATENT DOCUMENTS 4,053,332 10/1977 Egami et al. ..... 75/123

4,063,942 12/1977 Lundgren ..... 75/251

4,069,045 1/1978 Lundgren ..... 75/251

4,126,287 11/1978 Medelsohn et al. ..... 75/123

*Primary Examiner*—Brooks H. Hunt

*Attorney, Agent, or Firm*—Clinton S. Janes, Jr.

[57] ABSTRACT

This invention relates to the production of large shapes of metallic glasses from finely-dimensioned ribbons powders, flakes, wires, fibers, or filaments thereof. The inventive method contemplates placing the precursor finely-dimensioned articles of metallic glass into contact with one another and then hot pressing the mass at temperatures in the close vicinity of the glass transition temperature with applied forces of at least 1000 psi. One metallic glass, $Fe_{58}Cr_{14}Cu_6Si_6B_6$, which is readily shaped into bulk bodies via the inventive method, exhibits excellent resistance to attack by sea water.

4 Claims, 1 Drawing Figure

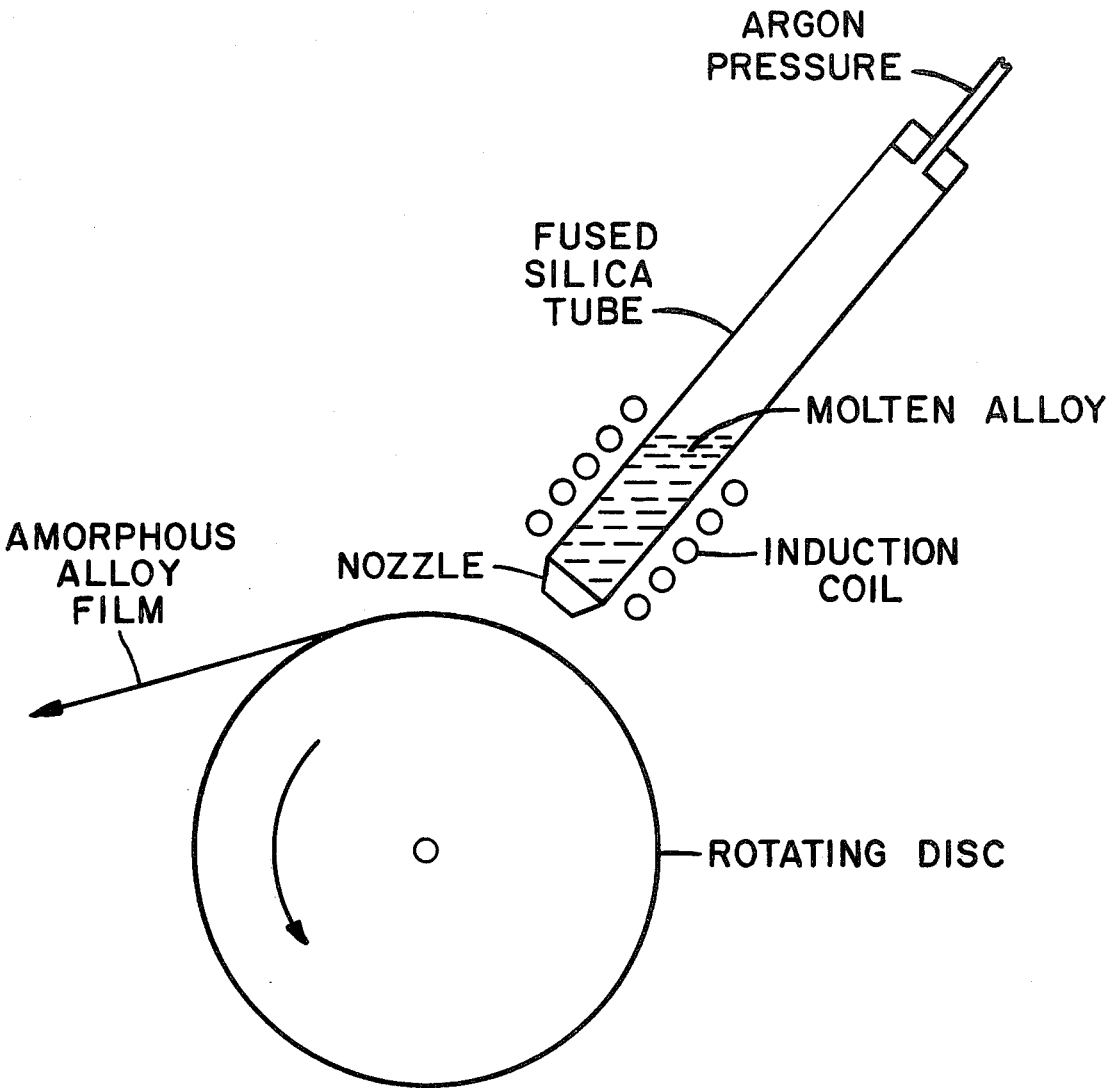
ARGON
PRESSURE
FUSED
SILICA
TUBE
MOLTEN ALLOY
AMORPHOUS
ALLOY
FILM
NOZZLE
INDUCTION
COIL
ROTATING DISC

METHOD FOR PRODUCING LARGE METALLIC GLASS BODIES

BACKGROUND OF THE INVENTION

A recent development in the field of metallurgy has been the production of metallic glasses. Metallic glasses comprise certain complex metal alloys which can be put into glass form, i.e., the bodies have a random atomic structure, by cooling melts of the alloys so rapidly that an organized crystal structure does not have time to develop. The production of such materials has involved forms of rapid melt quenching or various condensation processes, e.g., splat cooling, vapor deposition, electrodeposition, and sputtering. This requirement of rapid cooling has resulted in the newly-formed glasses being very small in at least one dimension, i.e., the bodies have commonly been in the shape of ribbons, flakes, wires, films, or powders. Thus, the largest articles formed from metallic glasses of particular alloy compositions have been thin sheets having a thickness of about 0.01–0.05 inches and about 25–65 mm in width.

Metallic glasses demonstrate magnetic and mechanical properties of great commercial potential. Iron-containing alloys have received much attention because of their exceptional ferromagnetic properties. With regard to mechanical properties, ribbons of certain metallic glasses have displayed extremely high fracture strength, i.e., approaching their theoretical strength, with highly localized shear deformation being observed to precede the tensile fracture. This phenomenon is in marked contrast to the brittle fracture behavior manifested by non-metallic glasses. In the latter, the fracture is characterized by crack initiation and propagation.

The density of normal liquid metals is about 5% less than that of the crystalline phase at the melting temperature. Based upon the difference in thermal expansion between liquid and crystalline metals, the density of metallic glasses at their transition temperatures would approach within 2% of the crystalline value and this circumstance has, indeed, been observed. Contrariwise, most non-metallic glasses and bodies formed through random, hard sphere packing exhibit densities that are about 15% less than those of the close-packed structure. This phenomenon can be attributed to the character of the metallic bonding which is such that the energy of a system is dominated by the average atomic volume, rather than the atomic distance.

The random atomic structure of metallic glasses is responsible for imparting unusual properties to them. For example, the materials are typically much stronger than crystalline metals, shear moduli in excess of 50 being reported on some compositions. Their essential insensitivity to many types of radiations, such as that from neutrons, has been noted. Moreover, in many instances, the metallic glass has been reported as demonstrating much greater corrosion resistance than the corresponding cyrstalline alloy.

However, practical application of metallic glasses has been severely limited because of the above-observed obstacle of body size in which the glasses have been produced. Hence, because these materials exhibit both a high diffusivity at the melting temperature and a relatively low glass transition temperature, the metal liquids customarily crystallize when cooled at rates at which some non-metallic liquids form glasses. Consequently, non-crystallized metals can only be prepared via drastic quenching techniques. Those factors giving rise to the crystallization of metals during conventional cooling of melts have also prevented the formation of bulk bodies of metallic glasses from the original powders, ribbons, films, etc., utilizing conventional forming techniques. Thus, when metallic glasses are heated to a point about half of their melting temperatures, they begin to lose their random structure, i.e., they begin to crystallize, and thereby lose their unique properties.

One solution which has been proposed to solve that problem has been to fuse or weld the finely-dimensioned starting materials together so quickly that crystallization does not have time to occur. The use of chemical explosives to force the materials together so quickly that heat buildup does not occcur has been tried with some success. Thus, simple shapes such as rods, plates, tubes, and cones have been prepared in this manner. Nevertheless, it is apparent that cost and technique complexity severely limit the application of that practice.

OBJECTIVES OF THE INVENTION

The primary objective of this invention is to provide a relatively simple method for fabricating bulk shapes of metallic glasses from finely-dimensioned starting materials.

A second objective of this invention is to provide a metallic glass which exhibits exceptional resistance to corrosion by sea water and which can be easily shaped into larger sheets by the inventive method.

SUMMARY OF THE INVENTION

The primary objective of this invention can be achieved by fusing together finely-dimensioned bodies of metallic glass. In broadest terms, the inventive method comprises two basic steps:

First, ribbons, powders, flakes, wires, fibers, or filaments of metallic glass are placed in touching or overlapping relationship with each other; and then Second, the mass is hot pressed in a non-oxidizing environment at temperatures at or in the close vicinity of the glass transition temperature ($T_g$) for a time sufficient to flow and fuse together into an integral unit.

In the non-metallic glass art, the transition temperature or transformation range has been generally defined as that temperature at which a liquid melt is transformed into an amorphous solid. This temperature has commonly been deemed to lie in the vicinity of the annealing point of the glass. The crystallization temperature ($T_x$) denotes the onset of crystallization which is indicated by a sharp dip in the curve generated in differential thermal analysis. Where a differential scanning calorimeter technique is employed, $T_g$ is defined as the temperature at the point of inflection on the heat capacity versus temperature plot and $T_x$ is read from a sharp dip in the generated heat capacity versus temperature curve. Those definitions are also applicable with metallic glasses.

It is apparent that devitrification will take place rapidly at the crystallization temperature. However, crystals also develop in the metallic glass after periods of time at temperatures below $T_x$. The method of the instant invention utilizes the flow of the glasses at temperatures at, slightly below, or slightly above their transition temperatures such that good sintering of the glass bodies will take place without the onset of crystallization. The mechanical deformation and pressurization at suitable temperatures near the respective transition temperature of each glass cause the material to flow rapidly enough to fuse together mechanically into an integral unit. In general, temperatures ranging from about 25° C. below the $T_g$ of an individual glassy alloy to about 15° C. above the $T_g$ thereof will be employed for times of at least five minutes at pressures of at least 1000 psi and, customarily, above 5000 psi. It will be recognized that higher pressures and longer periods of exposure are demanded where temperatures within the cooler extreme of the temperature range are utilized since the viscosity of the glass will be higher. On the other hand, devitrification of the glassy alloy takes place more rapidly at the higher temperatures of the fusion range. Consequently, the inventive process is founded in a carefully controlled relationship being maintained between the temperatures and pressures used, the optimum parameters being dependent upon the particular properties of a specific alloy.

Pressing periods in excess of about one hour frequently lead to the growth of extensive devitrification, especially at very high pressures, e.g., pressures in excess of about 100,000 psi. Accordingly, the preferred practice of the inventive method generally contemplates selecting fusion temperatures ranging from about 15° C. below the $T_g$ of a particular glass to about 10° C. above the $T_g$ thereof for periods of about 10–30 minutes at pressures of about 15,000–50,000 psi.

The glassy alloy having the approximate composition $Fe_{58}Cr_{14}Cu_6Si_6B_6$ was found to demonstrate excellent resistance to corrosion by sea water.

BRIEF DESCRIPTION OF THE DRAWING

The appended drawing provides a schematic representation of apparatus suitable for producing metallic glassy alloy ribbons via a centrifugal spinning technique.

DESCRIPTION OF PREFERRED EMBODIMENTS

Table I lists several metallic glasses which were prepared via sintering and melting high purity metals and reagent grade boron. Where lithium metal was a component, sintering was conducted in an atmosphere of argon to prevent rapid oxidation of the lithium. Metallic glass ribbons were produced by the centrifugal spinning technique described by Chen and Miller in *Materials Research Bulletin,* 11, 49 (1976). The method involves ejecting a stream of a melt from an orifice onto the outer surface of a rapidly rotating wheel, the wheel being driven by a variable speed motor. A schematic view of the apparatus is set forth in the appended drawing.

The alloy was melted in a quartz tube heated by an induction coil. The fused quartz tube had an injection orifice with a diameter of about 0.2–0.5 mm. The wheel was composed of a Cu-Be alloy to provide a surface of high polish and exceptional thermal conductivity. The wheel was rotated at velocities of about 300–2000 rpm, corresponding to tangential velocities of about 5–35 m/sec. The resulting quenched ribbons were typically about 3 mm in width, about 0.01"–0.05" in thickness, and several meters long. In some instances, ribbons up to 20 meters in length were prepared. The ribbons were relatively uniform in thickness. This circumstance was believed due to the fact that the melt never attains hydrostatic equilibrium during the process. The thickness of the ribbons varied roughly as the reciprocal of the spinning velocity.

The amorphous character of the ribbons was confirmed via X-ray diffraction analysis. Only very broad bands, with low absorption, were observed, such being typical of amorphous materials.

Samples were cut from the ribbons, weighed, and then sealed in aluminum sample pans for thermal analysis utilizing a Perkin-Elmer DSC-II differential scanning calorimeter. A preliminary scan of each alloy was made at a heating rate of 20° C./minute to determine the $T_g$ and $T_x$ of each composition. Those values are also reported in Table I.

TABLE I

| Amorphous Alloy Composition | $T_g$ | $T_x$ |
|---|---|---|
| $Fe_{68}Li_4Mo_4Al_6B_6$ | 455° C. | 465° C. |
| $Fe_{72}Ni_6B_6Mo_2$ | 476° C. | 495° C. |
| $Al_{44}Cu_{22}B_4C_4Li_2$ | 274° C. | 285° C. |

Samples of the metallic glasses of about 6–7 cm in length were edge ground and polished to facilitate fushion under pressure. An Astro Industries (Model #HP-50-7010) hot press having a die case diameter of six inches was employed for mechanical fusion. The system was capable of applying a maximum force of 50,000 psi and permitted the use of temperatures up to 2500° C. in controlled atmospheres. Air must be excluded during the hot pressing process to prevent oxide formation, particularly at the edges of the ribbons. Rapid destruction of physical properties of the ribbon samples occurs with oxidation. In the examples reported in Table II, about 35–42 strips of the metallic glass ribbons were positioned in edge-to-edge relationship or slightly overlapping. The mass of ribbons was then hot pressed at the temperatures, pressures, and times recorded in Table II.

Excellent fusion of the metallic glasses occurred in each example with edge-to-edge conjoinment. The seams between the individual ribbons were scarcely visible to the unaided eye. X-ray diffraction analyses of several portions of the seams in each specimen evidenced no crystallization. Laboratory experience has indicated that the more complex the composition of the metallic glass alloy the greater the ease of fusion without crystallization. This circumstance is consistent with the hypothesis that the greater the availability of different types of metal atoms in the fluid or viscous state, the greater is the difficulty in aligning the metal atoms to crystallize.

TABLE II

| Alloy Composition | Temperature | Applied Force | Time |
|---|---|---|---|
| $Fe_{68}Li_4Mo_4Al_6B_6$ | 445° C. | 25,000 psi | 15 min. |
| $Fe_{72}Ni_6B_6Mo_2$ | 470° C. | 30,000 psi | 25 min. |
| $Al_{44}Cu_{22}B_4C_4Li_2$ | 260° C. | 15,000 psi | 15 min. |

Table III compares the axial strengths of the fused sheets with those of the original metallic glass ribbons. As can be observed, the tensile strengths were commonly quite close to those exhibited by the ribbons. Transverse strengths, however, were only about 80–85% of those demonstrated by the precursor ribbons. Failure of all the sheet specimens occurred at the seams.

TABLE III

| | Tensile Strengths (psi) | | | |
|---|---|---|---|---|
| | Axial | | Transverse | |
| Alloy Composition | Ribbon | Sheet | Ribbon | Sheet |
| $Fe_{68}Li_4Mo_4Al_6B_6$ | 410,000 | 402,000 | 227,000 | 174,800 |

TABLE III-continued

| Alloy Composition | Tensile Strengths (psi) Axial Ribbon | Axial Sheet | Transverse Ribbon | Transverse Sheet |
|---|---|---|---|---|
| $Fe_{72}Ni_6B_6Mo_2$ | 485,000 | 475,000 | 660,000 | 559,000 |
| $Al_{44}Cu_{22}B_4C_4Li_2$ | 542,000 | 525,000 | 510,000 | 409,000 |

Strips of the $Al_{44}Cu_{22}B_4C_4Li_2$ were also fused together into an integral product via hot pressing at about 284° C., i.e., about 10° C. above the $T_g$ thereof, at 13,000 psi for 25 minutes. X-ray diffraction analyses of the fused product indicated the absence of devitrification. As is demonstrated in Table IV below, the axial and transverse strengths (psi) were comparable to those reported in Table III above resulting from hot pressing at temperatures below the $T_g$ thereof.

TABLE IV

| Alloy Composition | Axial Ribbon | Axial Sheet | Transverse Ribbon | Transverse Sheet |
|---|---|---|---|---|
| $Al_{44}Cu_{22}B_4C_4Li_2$ | 542,000 | 495,000 | 510,000 | 384,000 |

The formula $Fe_{58}Cr_{14}Cu_6Si_6B_6$ designates the composition of a metallic glass which combines ease of production by centrifugal spinning with excellent chemical durability. In point of fact, metallic glasses have been prepared in the composition region, expressed in weight percent, of 68.5–72% Fe, 14–16% Cr, 7–9.5% Cu, 2–5% Si, and 0.5–3% B. However, the most desirable chemical durability appears to focus on the ratio of $Fe_{58}Cr_{14}Si_6$ with substantial deviations of Cu and B from the base composition commonly yielding devitrification and/or chemical durability problems.

Considerable difficulty was experienced in hot pressing strips of glassy $Fe_{58}Cr_{14}Cu_6Si_6B_6$ alloy into an integral, crystal-free body. Essentially complete bonding was secured but X-ray diffraction analyses have evidenced a measure of crystallization. Although the amount of this crystallization is small, commonly about 1–3% by volume, the presence thereof greatly decreases the strength of the formed sheet, when compared to that exhibited by the precursor ribbons. This phenomenon is evidenced in the axial and transverse strengths (psi) reported in Table V below following hot pressing at 720° C. at 42,000 psi for 45 minutes.

TABLE V

| Alloy Composition | Axial Ribbon | Axial Sheet | Transverse Ribbon | Transverse Sheet |
|---|---|---|---|---|
| $Fe_{58}Cr_{14}Cu_6Si_6B_6$ | 360,000 | 110,000 | 286,000 | 86,500 |

This difficulty in controlling the viscosity of the metallic glass to induce flow without concomitant devitrification is believed to be a result of the limited composition area for metallic glass formation in this alloy system. Nevertheless, as was explained above, the selection of the proper temperatures and pressures to achieve total glass fusion can be determined empirically within the cited parameters, and is well within the skill of the glass technologist.

The examples reported in Tables I-V must be deemed illustrative only and not limitative. Thus, the proper correlation of pressing temperature and applied pressure renders the inventive method applicable to any metallic glass. The only limitations to the present method appear to be practical ones, i.e., the size of the die chamber diameter and the uniformity of the ribbon samples.

Samples of the amorphous alloys were subjected to various concentrations of acids and bases, viz. 1 M, 6 M, and 12 M HCl, 1 M, 6 M, and 15 M $HNO_3$, as representative of usual acid and oxidizing acid environments, respectively, and in 1 M NaOH and 1 M $NH_3$ to simulate strong and weak alkaline media. The ammonia provided an additional factor of complexation for any metal ions formed in a corrosion reaction. Weight loss determinations, color, and microscopic examinations were utilized to assess surface attack.

Also, a simulated sea water test was devised to screen alloy samples for resistance to sea water corrosion. Artificial sea water was obtained from the Aquarium Supply Company of Trenton, New Jersey, and the pH adjusted to 7.4 with minute additions of 1 M NaOH to approximate the average ph of sea water. Air was bubbled through the water at a rate of about 4 liters/hour to insure a continuous oxygen supply for corrosive processes. Furthermore, the sea water was continually circulated at a temperature of about 27° C. to simulate ocean currents.

Iron-based alloys were selected for testing because of their relative ease of preparation and the known metallic of mixed metal-iron alloys. Aluminum, boron, and silicon metals were incorporated as metalloids to facilitate amorphous alloy formation. Ribbons of the amorphous alloys were prepared in accordance with the method described above with reference to the exemplary compositions reported in Table I. In general, visual observation was sufficient to indicate whether the ribbon was glassy or crystalline. However, where there was a question as to the presence of crystallization, the ribbons were examined via X-ray diffraction. On the basis of the above screening practice, the following three non-crystalline alloys were chosen for testing in the acid and basic environments:

$Fe_{58}Cr_{14}Cu_6Si_6B_6$
$Fe_{72}Ni_6B_6Mo_2$
$Fe_{68}Li_4Mo_4Al_6B_6$

Resistance to concentrated and to oxidizing acids would indicate potential uses of the amorphous alloys in chemical regenerators, reaction flasks, and/or chemical storage containers. The results of the chemical tests are reported in Tables VI and VII. All of the ribbon specimens were immediately attacked by 1 M HF, although the $Fe_{58}Cr_{14}Cu_6Si_6B_6$ alloy seemed to form a surface-protective layer of a fluoride. Hence, following the initial reaction with the HF, the bulk alloy becomes relatively impervious to further attack. Extensive crystallization occurred on the other alloys even after one hour.

The $Fe_{72}Ni_6B_6Mo_2$ and $Fe_{68}Li_4Mo_4Al_6B_6$ metallic glasses were severely attacked by the concentrated HCl and $HNO_3$ solutions, with essentially complete dissolution taking place after a very short immersion in the $HNO_3$. In contrast, the $Fe_{58}Cr_{14}Cu_6Si_6B_6$ glassy alloy was substantially unaffected in the same media with only minor surface discoloration becoming evident after immersion for 24 hours in concentrated $HNO_3$. Similar behavior was observed for the three alloys in hydrochloric acid of medium concentration. The $Fe_{58}Cr_{14}Cu_6Si_6B_6$ composition appeared to be more extensively attacked in HCl than in $HNO_3$. The attack in the 6 M and 12 M HCl solutions is believed to be due to the acid ($H^+$ ions) followed by complexation of the resulting metal ions with $Cl^-$ ions. This action causes the acid attack to occur more rapidly in HCl than in $HNO_3$ by removing metal ions near the surface and shifts the equilibrium to the formation of more metal ions. Nitric acid is a non-complexing medium and, therefore, the acid attack is kinetically slow.

The $Fe_{68}Li_4Mo_4Al_6B_6$ glass appeared to be virtually inert to the 1 M NaOH whereas the surface of the $Fe_{72}Ni_6B_6Mo_2$ glassy alloy was corroded quickly and the body dissolved slowly, i.e., about a 5% weight loss in 24 hours. The $Fe_{58}Cr_{14}Cu_6B_6Si_6$ metallic glass was attacked quite slowly but some surface pitting was noted after an exposure of 24 hours.

Immersion into $NH_3$ caused hydroxy salts and oxides to form on the surface of all the glassy alloys. However, the $Fe_{58}Cr_{14}Cu_6B_6Si_6$ composition displayed only minor surface tarnish after immersion for 24 hours and no significant change in weight. The corrosion or tarnish caused by the ammonia, when compared with the effect of 1 M NaOH, is assumed to reflect the complexing ability of $NH_3$ with the metal ions formed. Thus, the complex formation of metal ions with $NH_3$ to give $M(NH_3)_n^{+x}$ removes the metal ion resulting from the surface reaction and exposes more glassy alloy to the solution.

Disintegration and embrittlement of the two compositions occurred over the period of three to six months. The crystalline analogs of each glassy alloy were tested in the same medium and all the ribbons demonstrated significant corrosion after one week. It was quite clear, however, that each of the amorphous alloys was definitely more resistant to attack than the crystalline analog thereof over the same period of exposure. This is consistent with the hypothesis that the elimination of grain boundaries appears to reduce chemical attack in amorphous alloys, which attack may occur at the active sites of grain boundaries of crystalline alloys.

In view of the above evaluations, the $Fe_{58}Cr_{14}Cu_6Si_6B_6$ metallic glass is deemed to be particularly desirable for applications where contact with sea water is involved.

The specimens subjected to the tests reported in Tables VI-VIII were ribbons having a length of about six inches. The ribbons of glassy alloy $Fe_{58}Cr_{14}Cu_6Si_6B_6$ were about 2.5 mm wide and 32 microns thick; those of $Fe_{72}Ni_6B_6Mo_2$ were about 2 mm wide and 28 microns thick; and those of $Fe_{68}Li_4Mo_4Al_6B_6$ were about 2.3 mm wide and 35 microns thick. Weight losses are reported in parentheses. N.R. indicates no reaction evident.

TABLE VI

| | Acid and Basic Durability After One Hour | | | | | | | | |
|---|---|---|---|---|---|---|---|---|---|
| Glassy Alloy | 1M NaOH | 1M NH | 1M HF | 1M HCl | 6M HCl | 12M HCl | 1M $HNO_3$ | 6M $HNO_3$ | 15M $HNO_3$ |
| $Fe_{58}Cr_{14}Cu_6Si_6B_6$ | Surface Attack (0.80%) | N.R. | Pitted | N.R. | Dissolved | Dissolving | N.R. | N.R. | Dissolved (0.2%) |
| $Fe_{72}Ni_6B_6Mo_2$ | Rusty (3.1%) | Crystals on Surface | Pitted | Tarnish, Surface Attack (<0.2%) | Rusty | Dissolving (3.5%) | Rusty | Dissolving (33%) | Dissolved (100%) |
| $Fe_{68}Li_4Mo_4Al_6B_6$ | N.R. | Crystals on Surface | Pitted | Tarnish (0.93%) | Rusty | Dissolving (11.5%) | Pitted | Dissolving (48%) | Dissolved (100%) |

TABLE VII

| | Acid and Basic Durability After 24 Hours | | | | | | | | |
|---|---|---|---|---|---|---|---|---|---|
| Glassy Alloy | 1M NaOH | 1M NH | 1M HF | 1M HCl | 6M HCl | 12M HCl | 1M $HNO_3$ | 6M $HNO_3$ | 15M $HNO_3$ |
| $Fe_{58}Cr_{14}Cu_6Si_6B_6$ | Surface Pitting (1.6%) | Tarnish | Surface (1.0%) | N.R. | Some rust | Dissolving (58%) | N.R. | N.R. | Tarnish (0.6%) |
| $Fe_{72}Ni_6B_6Mo_2$ | Rust, Pitting (5.3%) | Heavy Deposit of Crystals | Pitted, Crystals on Surface | Tarnish (0.38%) | Rust | Dissolved (100%) | Rusting, Pitted | Dissolved (100%) | Dissolved in One Hour |
| $Fe_{68}Li_4Mo_4Al_6B_6$ | N.R. (<0.1%) | Heavy Deposit of Crystals | Pitted, Crystals on Surface | Pitted (2.1%) | Rust | Dissolving (83%) | Pitted Rust | Dissolved (100%) | Dissolved in One Hour |

TABLE VI

| | Corrosion Resistance to Artificial Sea Water | | | |
|---|---|---|---|---|
| Glassy Alloy | One Week | One Month | Three Months | Six Months |
| $Fe_{58}Cr_{14}Cu_6Si_6B_6$ | N.R. | N.R. | N.R. | N.R. |
| $Fe_{72}Ni_6B_6Mo_2$ | Pitted, Rusting | Pitted, Heavy Rusting | Rusting, Disintegration | — |
| $Fe_{68}Li_4Mo_4Al_6B_6$ | Pitted, Rusting | Heavy Surface Corrosion | Heavy Surface Corrosion | Brittlement, Disintegration |

The evalution of the anti-corrosive resistance of the glassy ribbons in the synthetic sea water environment is summarized in Table VIII. The $Fe_{58}Cr_{14}Cu_6Si_6B_6$ glassy alloy did not evidence any corrosion even after six months' immersion. In contrast, the other alloys exhibited rusting after an exposure of only one week.

I claim:

1. A method for preparing large shapes of metallic glasses from precursor finely-dimensioned bodies thereof which comprises:

(a) placing said finely-dimensioned bodies in touching relationship with each other, and then (b) hot pressing said bodies in a non-oxidizing environment at temperatures ranging from about 25° C. below the glass transition temperature to about 15° C. above the transition temperature of said metallic glass under an applied force of at least 1000 psi for a period of time sufficient to cause the bodies to flow and fuse together into an integral unit.

2. A method according to claim 1 wherein said period of time ranges up to about one hour.

3. A method according to claim 1 wherein said temperatures range about 15° C. below the transition temperature of the glass to about 10° C. above the transition temperature thereof, said applied force varies between about 15,000–50,000 psi, and said time is between about 10–30 minutes.

4. A method according to claim 1 wherein said metallic glass exhibits exceptional resistance to sea water and has the formula $Fe_{58}Cr_{14}Cu_6Si_6B_6$.

* * * * *